United States Patent [19]

Lighter

[11] Patent Number: 4,911,436

[45] Date of Patent: Mar. 27, 1990

[54] PNEUMATIC HOME FITNESS CENTER

[75] Inventor: Jay Lighter, Pompano Beach, Fla.

[73] Assignee: Pneu-Body, Inc., Pompano Beach, Fla.

[21] Appl. No.: 44,009

[22] Filed: Apr. 29, 1987

[51] Int. Cl.[4] ..... A63B 21/00

[52] U.S. Cl. ..... 272/130; 272/134

[58] Field of Search ..... 272/130, 134, 136, 142

[56] References Cited

U.S. PATENT DOCUMENTS

| | | | |
|---|---|---|---|
| 3,822,599 | 7/1974 | Brentham | 272/130 X |
| 4,146,222 | 3/1979 | Hribar | 272/130 X |
| 4,167,938 | 9/1979 | Remih | 272/130 X |
| 4,231,568 | 11/1980 | Riley et al. | 272/136 |
| 4,257,593 | 3/1981 | Keiser | 272/130 |
| 4,275,882 | 6/1981 | Grosser et al. | 272/130 X |
| 4,353,547 | 10/1982 | Jenkinson | 272/130 |
| 4,397,462 | 8/1983 | Wilmarh | 272/130 |
| 4,465,274 | 8/1984 | Davenport | 272/130 |
| 4,492,375 | 1/1985 | Connelly | 272/136 X |
| 4,576,377 | 3/1986 | Wolff | 272/130 |
| 4,643,420 | 2/1987 | Riley et al. | 272/136 X |
| 4,667,955 | 5/1987 | Giesch | 272/134 X |

FOREIGN PATENT DOCUMENTS

| | | | |
|---|---|---|---|
| 2173115 | 10/1986 | United Kingdom | 272/130 |

OTHER PUBLICATIONS

Advertisement for "The Lean Machine", In Sports Illustrated, Feb. 27, 1984, p. 84.

*Primary Examiner*—Richard J. Apley
*Assistant Examiner*—Robert W. Bahr
*Attorney, Agent, or Firm*—Fleit, Jacobson, Cohn, Price, Holman & Stern

[57] ABSTRACT

A pneumatic home fitness center embodying a pivotal lever arm with air cylinders associated therewith to provide a gradual and progressive resistance to movement of the lever arm combined with control arrangements to enable both an anaerobic and aerobic exercise technique to be practiced combined with accessory items enabling all muscle groups to be exercised. The device includes a supporting base having an upstanding front pillar or frame structure with a vertically adjustable sleeve thereon and the sleeve including a mount for the pivotal lever arm and air cylinders that have flexible rubber air chambers therein with controls to vary the resistance to movement of the lever arm combined with an adjustable and removable bench supported from the base and pillar and various attachments enabling multiple uses and functions of the device.

7 Claims, 2 Drawing Sheets

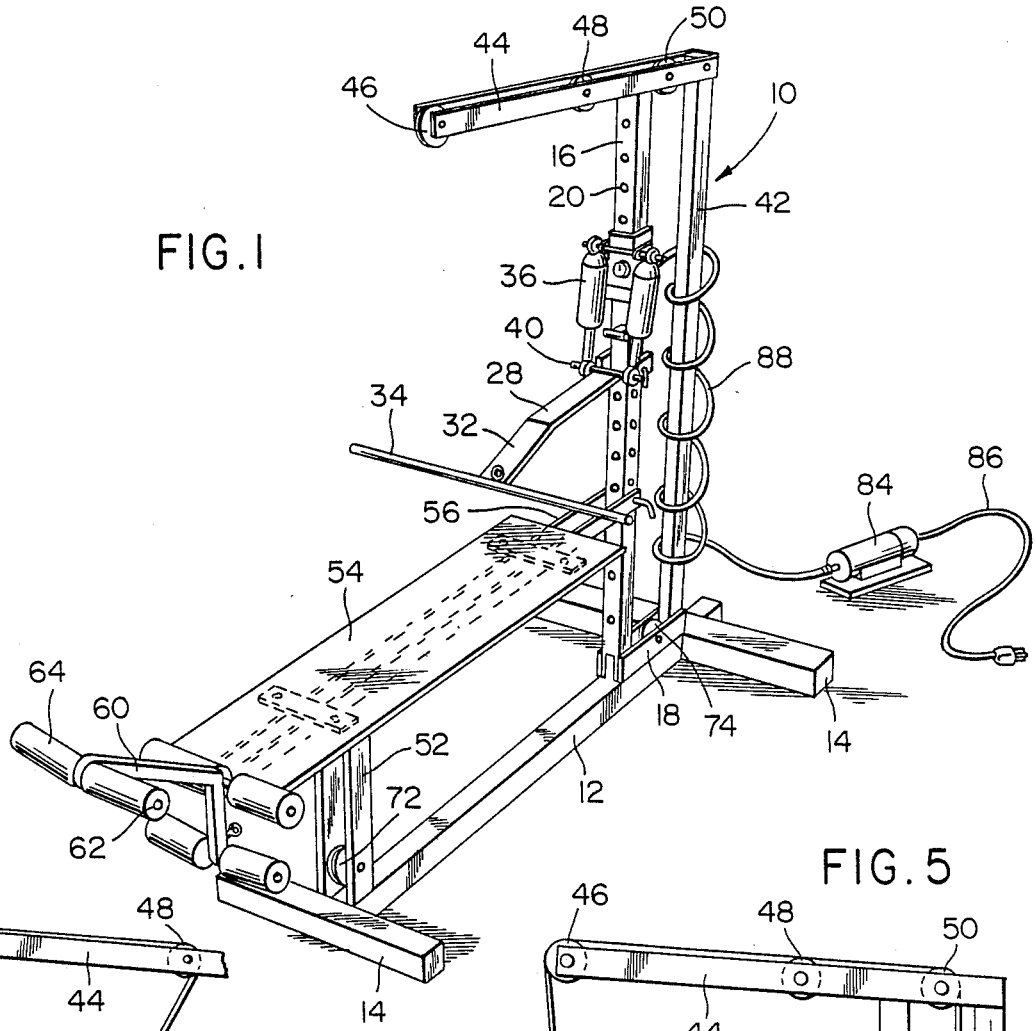
FIG. 1
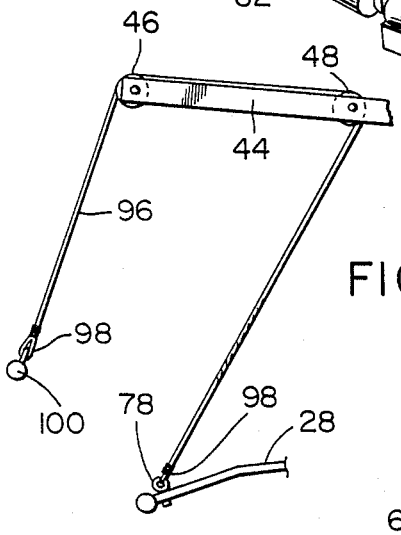
FIG. 4
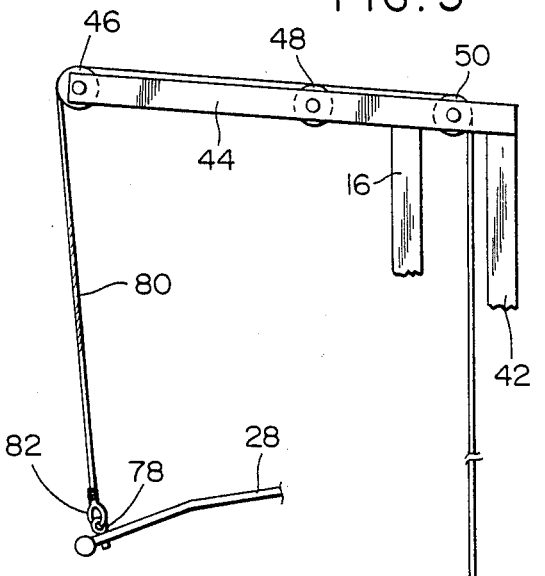
FIG. 5
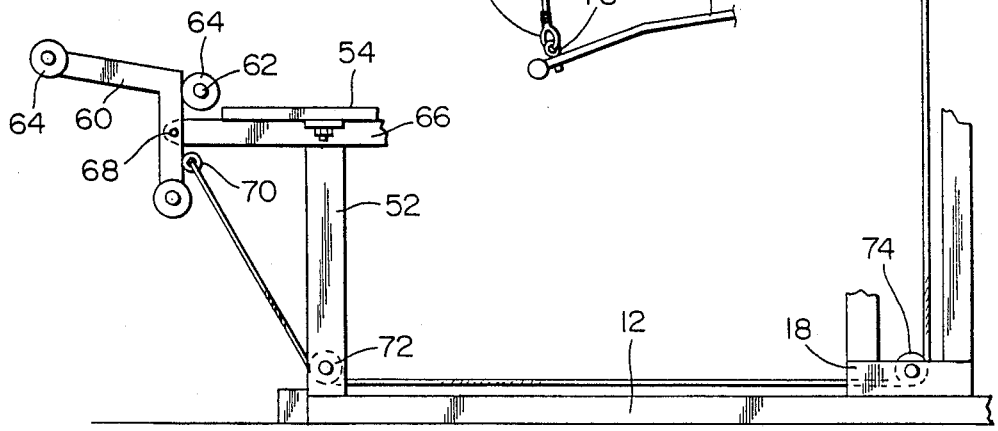

PNEUMATIC HOME FITNESS CENTER

BACKGROUND OF THE INVENTION

1. Field of the Invention

The present invention generally relates to a pneumatic home fitness center embodying a pivotal lever arm with unique air cylinders associated therewith to provide a gradual and progressive resistance to movement of the lever arm combined with unique control arrangements to enable both an anaerobic and aerobic exercise technique to be practiced combined with accessory items enabling all muscle groups to be exercised. The device includes a supporting base having an upstanding front pillar or frame structure with a vertically adjustable sleeve thereon and the sleeve including a mount for the pivotal lever arm and unique air cylinders that have flexible rubber air chambers therein with controls to vary the resistance to movement of the lever arm combined with an adjustable and removable bench supported from the base and pillar and various attachments enabling multiple uses and functions of the device.

2. Information Disclosure Statement

Various types of exercise equipment have been provided utilizing movable members contacted by various portions of the human anatomy combined with various structures for resisting movement of the movable members and patents exist covering this basic concept but the prior art known to applicant does not include structural features pertinent to the present invention. A separate information disclosure statement will be filed.

SUMMARY OF THE INVENTION

An object of the present invention is to provide a home fitness center in the form of an exercise device utilizing a vertically adjustable pivotal lever arm combined with unique air cylinders having flexible rubber air chambers therein providing a gradual progressive resistance to movement of the lever arm.

Another object of the invention is to provide a home fitness center in accordance with the preceding object in which the lever arm is supported from a vertically disposed pillar having a sleeve slidably mounted thereon that is secured in vertically adjusted position and including a pivotal support for the end of the lever arm and mounting points for the air cylinders which have their opposite ends connected to the lever arm in spaced relation to the point of pivotal support of the lever arm for resisting pivotal movement of the lever arm.

A further object of the invention is to provide a device in accordance with the preceding objects incorporating a supporting base having the pillar rigidly connected thereto and providing a support for an adjustable bench enabling a person using the device to be oriented in various relationships to the device for exercising various muscle groups.

Still another object of the invention is to provide a device in accordance with the preceding objects utilizing cable and pulley accessories providing exercises for almost all muscle groups by arranging the accessory items in various positions to enable the practice of various exercise regimens.

A still further object of the invention is to provide a home fitness center in the form of n exercising device in accordance with the preceding objects having readily accessible control arrangements to increase or decrease resistance to movement of the lever arm with a visual indicator providing the user information with respect to the level of resistance to movement of the lever arm with the structure being capable of multiple functions but yet relatively inexpensive to manufacture and effective for use as a home exercising device or fitness center.

These together with other objects and advantages which will become subsequently apparent reside in the details of contruction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the home fitness center of the present invention.

FIG. 4 is a schematic illustration of another use of the device.

FIG. 5 is a schematic elevational view of a further use of the device.

DESCRIPTION OF THE PREFERRED EMBODIMENT

Figure 2:
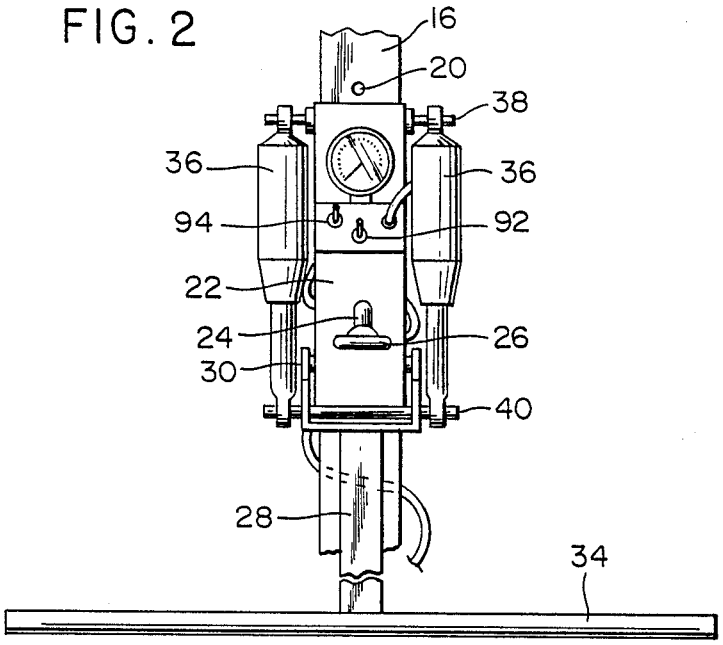
FIG. 2 is a detailed elevational view of the slide mounted on the pillar illustrating the association of the air cylinders to the lever arm and slide.
Figure 3:
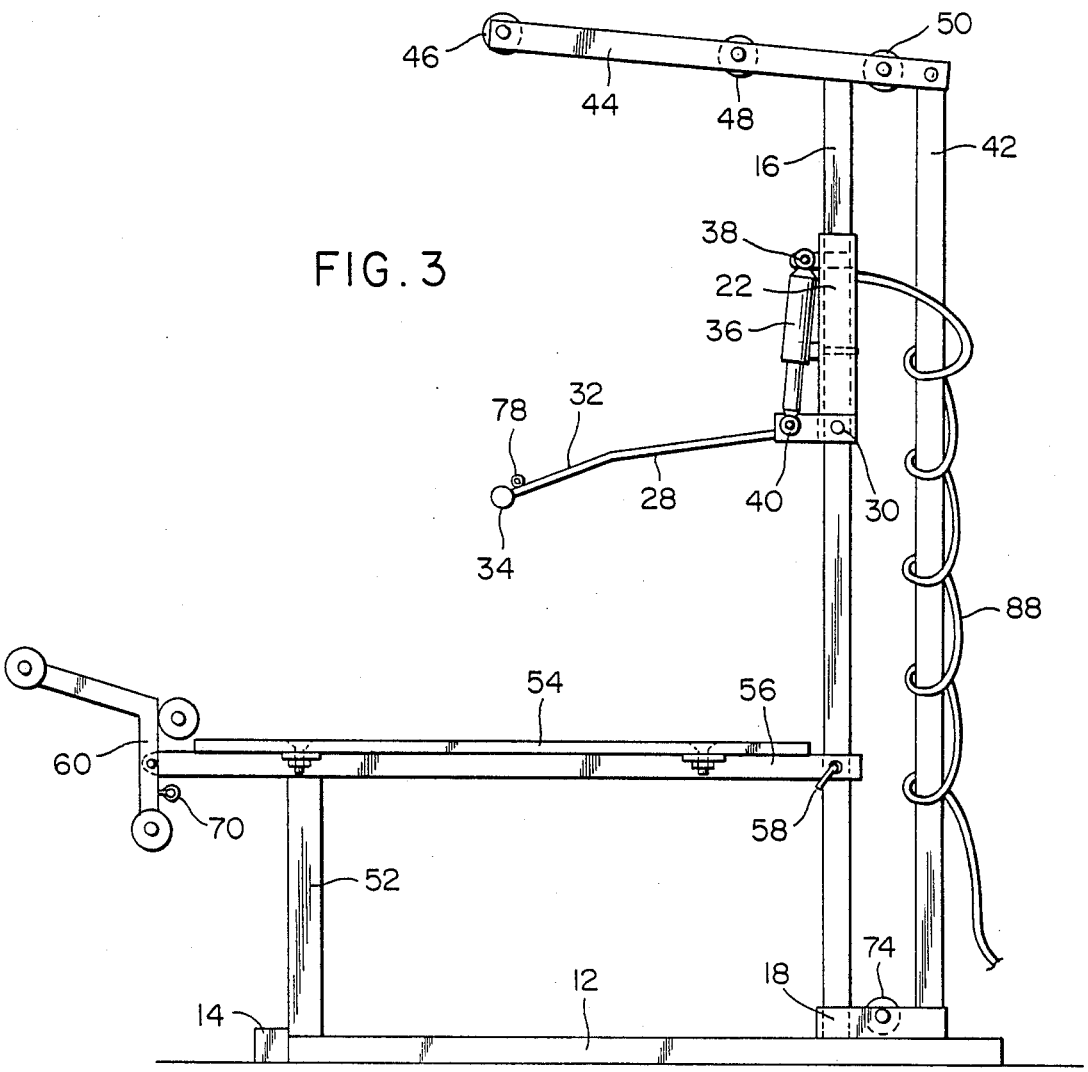
FIG. 3 is a side elevational view of the device.

Referring now specifically to the drawings, the home fitness center of the present invention is generally designated by reference numeral 10 and includes an elongated, horizontally disposed lower support frame member or beam 12 provided with a transverse frame member or beam 14 at both or either end of the beam 12 to provide a stable support for the home fitness center 10. The members 12 and 14 may conveniently be tubular structural members of any desired cross-sectional configuration and any desired cushioning or protective pads may be provided to engage a supporting surface to protect the supporting surface and retain the home fitness center stationary on the supporting surface. The beams 12 and 14 thus form a supporting base for the home fitness center and the exact shape, configuration and dimensional characteristics of the base may vary as long as it has sufficient strength characteristics to support the other components of the home fitness center.

Extending rigidly and upwardly from the center beam 12 is a pillar or frame member 16 which may also be a tubular structural member preferably square in configuration but capable of being constructed in other cross-sectional configurations with the lower end thereof being secured to the beam 12 by being welded or otherwise secured between flanges 18 extending upwardly from the beam 12. The pillar 16 includes a plurality of uniformly spaced apertures 20 throughout the length thereof to provide vertically adjustable support for a tubular sleeve 22 of the same cross-sectional configuration which closely engages the exterior surface of the pillar but slides vertically thereon. The sleeve 22 can be locked in vertically adjusted position by a spring biased latch assembly 24 having a T-handle 26 on the outer end of a pin which is spring biased inwardly so that the inner end of the pin will engage one of the apertures 20 to secure the sleeve 22 in adjusted position on the pillar 16. Thus, the person using the device may easily adjust the sleeve vertically on the pillar 16 by grasping the T-handle 26 and pulling it outwardly against the tension of a compression coil spring to retract the inner end of a locking pin from the aperture 20 in which it is received so that when the sleeve 22 is adjusted to desired position, the handle 26 can be released and the sleeve locked in vertically adjusted position.

An elongated lever arm 28 in the form of a channel shaped member, tubular member or other structural shape is pivotally connected to the lower end portion of the sleeve 22 by pivot pins or a pivot cross haft at 30 to enable the outer end of the lever arm 28 to pivot in a vertical plane about a horizontal axis. The outer end portion of the lever arm 28 is angulated downwardly at 32 and provided with a transverse T-handle 34 which is horizontally elongated.

A pair of air cylinders 36 interconnect the lever arm and the upper end portion of the sleeve 22 with the upper ends of the air cylinders being connected to pivot pins or a cross shaft 38 at the upper end of the sleeve 22 and the lower ends of the air cylinders 36 are pivotally connected to the lever arm 28 by a pivot pin or cross shaft 40 that is spaced from the pivot pins or cross shaft 30 joining the end of the lever arm 28 to the sleeve so that pivotal movement of the lever arm 28 will be resisted by the air cylinders 36. The air cylinders 36 are in the form of modified automotive pneumatic shock absorbers that have a flexible rubber air chamber therein which expands and contracts with differing pressures which provides a very gradual and progessive resistance to movement of the lever arm. The use of the flexible rubber air chambers eliminates the necessity of an auxiliary air reservoir or other fluid reservoir used in other known hydraulic or pneumatic exercising devices.

Oriented parallel to but spaced from the pillar 16 is a frame member or forwardmost pillar 42 which may be in the form of a tubular steel structural member that is also connected to the forward end of the center beam 12 or transverse frame member 14 by welding or otherwise being secured to the flanges 18 which extend upwardly from the upper surface of the beam 12 and beam 14. The upper end of the pillar 16 and pillar 42 includes an overhead beam or support 44 rigidly attached to the pillars 16 and 42 in any suitable manner with a plurality of pulleys 46, 48 and 50, respectively, journalled thereon with the overhead support member or beam 44 being in the form of spaced structural members having the pulleys journalled therebetween with suitable shafts and bushings with the pulley 46 being at the end of the overhead support which overlies the longitudinal beam 12, the pulley 48 being generally at the center thereof and the pulley 50 being disposed between the upper ends o the pillars 16 and 42 with the overhead support beam 44 being secured to the pillars 16 and 42 in any suitable manner such as by the use of bolts or other fastending arrangements, welding or the like.

Also attached to the center longitudinal beam 12 in spaced relation to the pillar 16 is an upright support 52 which supportingly engages a bench 54 adjacent one end thereof remote from the pillar 16. The bench is of rectangular configuration and may be constructed of wood, metal or the like and provided with cushioning or covering material of any suitable type utilized in exercising benches. The end of the bench 54 adjacent the pillar 16 is vertically adjustably and detachably connected to the pillar 16 by the use of a pair of spaced brackets 56 which extend alongside of the vertical surfaces of the pillar 16 and detachably and adjustably connected thereto by a removable pin 58 received through a plurality of apertures 60 extending horizontally from side to side through the pillar 16 with the apertures only being arranged at the lower portion of the pillar 16 since the end of the bench 54 will remain below the sleeve 22.

Mounted at the end of the bench opposite to the pillar 16 is a leg curl extension 60 in the form of an angulated member provided with a plurality of laterally extending support members 62 having foam rubber or plastic cylindrical cushions 64 mounted thereon so that the legs, ankles, feet and the like can be engaged with the foam cushions for moving the leg curl extension 60 when positioned in various relationships to the bench 54 with the leg curl extension 60 being pivotally attached to and detachably connected to the support members 52 or the bench 54 by pivot pin or bolt 68. If desired, the leg curl extension can be attached to the upright supports 52 for pivotal movement so that the bench 54 can be removed either along with the leg extension or the leg extension can be left in place by connection with the upright supports 52. Likewise, the upper end of the leg supports 52 are detachably connected to the bench support member 66 so that the bench can be easily removed and the support members 52 may be detachably connected to the beam 12 for removal if desired. Also, the leg curl extension 60 is provided with an eye 70 mounted thereon adjacent the lowermost support member 62 and a pulley 72 is mounted on the upright support members 52 adjacent the lower end thereof and a pulley 74 is mounted on the beam 12 between the lower ends of the pillars 16 and 42. Also, a cable attachment eye 78 is provided on the lever beam 28 adjacent the handle 34 with both the cable attachment eyes 70 and 78 being in the form of an eye bolt or other suitable means for connection with a cable accessory 80 which has loops 82 formed in the ends thereof for connection with the cable attachments 70 and 78 and for entrainment over the various pulleys 46, 48, 50 and 74 to enable various exercise regimens to be practiced.

An air compressor 84 is provided to vary the air pressure in the air cylinders 36 with the compressor 84 adapted to be plugged into a household electrical outlet by cord and plug assembly 86 and provided with a hose and electrical control cable 88 which extends to the sleeve 22 for enabling air pressure in the air cylinders 36 to be raised or lowered as indicated by a guage 90 on the sleeve 22 which will indicate to the user the air pressure in the cylinders 36. The control cable and air hose are spirally wound around the pillar 42 as illustrated in FIG. 1 so that the hose and control cable 88 may move vertically with the sleeve 22 when it is adjusted on the pillar 16. A switch 92 is provided on the sleeve for actuating the compressor 84 to increase the pressure in the air cylinders 36 and thus increase resistance to movement by the lever arm 28. Also mounted on the sleeve 22 is a pressure release switch 94 which includes a valve to release air from the air cylinders thus reducing the pressure in the air cylinders and reducing resistance to movement of the lever arm 28. The air hose and electrical control cable 88 are of conventional construction and may be in the form of a flexible metal air line and wire housing with electrical control cable incorporated therein or added alongside thereof so that operation of the switches 92 and 94 will selectively actuate the compressor to increase the pressure and resistance by moving the switch 92 between off and on position and to release air pressure from the air cylinders by moving the switch 94 which controls an air discharge valve thereby providing accurate and varied resistance to movement of the lever arm 28. The compressor 84 may be mounted on the base or separated therefrom. To maintain the assembly in desired position, the compressor can be mounted on the front pillar 42 or on the base frame in any suitable manner.

As illustrated in FIG. 4, the device is illustrated in use with an accessory cable 96 which has a loop 98 on one end thereof for connection with the attachment point or eye 78 on the lever arm 28 with the cable 96 then extending upwardly over the center pulley 48 and forwardly over the pulley 46 and then downwardly with the other end of the cable being connected to a lateral handle or bar 100 so that the lateral bar or handle 100 or other loop-type handle or the like attached to the cable 96 can be moved against the resistance of pivotal movement of the lever arm 28. FIG. 5 illustrates the leg curl arrangement in which the cable 80 extends upwardly over the pulley 46 and thus above the pulley 48 and around the pulley 50 and down to the pulley 74 and then under the pulley 72 for connection to the attachment point 70 on the leg curl extension 60.

In use, the device may be installed in any area of the home having sufficient head room and the electrical cord and plug 86 is connected to a conventional outlet. The system is activated by simply actuating the compressor activating switch 92 to provide a desired pressure in the air cylinders. Thereafter, the resistance to movement of the lever arm 28 is instantly controlled by adding resistance by increasing the pressure by operating the switch 92 or reducing resistance by reducing pressure by actuating the switch which controls the release valve for air pressure in the cylinders. The resistance is clearly indicated at all times by the pressure guage 90 with the upward movement of the lever arm increasing the air pressure in the cylinders so that resistance to movement is progressively increased thus providing both an anaerobic and aerobic exercise regimen. By utlilizing the cables and lateral bar the home fitness center provides exercise for every muscle group. Thus, by simply changing the route of the cables, the user can perform virtually every conventional muscle building exercise with all of the arrangements utilizing the same lever assembly and the same variations in resistance by operating the switches 92 and 94 and observing the resistance on the pressure guage 90. The arrangement of the cables being non-fixed simulates the effect of free weights since there is a considerable cable span that enables movement of the component which contacts a portion of the human anatomy.

The bench 54 is easily adjustable on the front pillar to provide both an incline and a decline with this adjustment being simply accomplished by removal and insertion of the front support pin. Also, the bench may be completely removed along with the leg curl extension by disconnection of the bench from the support elements or disconnection of the support elements for the end of the bench adjacent the leg curl extension. Resistance is applied to the leg curl extension from the lever assembly by the cable assembly 80 as illustrated in FIG. 5. The cable assembly 96 illustrated in FIG. 4 together with the lateral bar 100 also utilizes the resistance supplied from the lever 28 to enable various exercises to be performed. The air cylinders 36 are air shock absorbers having flexible rubber air chambers therein provided with a valve to enable inflation and deflation or variance in pressure in the air chambers in a well-known manner with the air supply being connected to the rubber air chambers through air valves normally provided on the air shock absorbers with the pressure guage also being connected to the air cylinders to register the pressure in the air chambers and the valve and switch 94 being communicated with the air chambers for release of air pressure therefrom when the switch 94 is activated. The simple manually operated spring latch device locks the sleeve 22 into any adjusted position with a single quick pull of the latch with the entire control assembly being mounted on the sleeve in a position for ready access to the user of the device which results in a relatively simple and compact home fitness center or exercising device that is quickly and easily controlled and capable of being used in many arrangements for exercising almost all muscle groups.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A home fitness center comprising a supporting base, an upright pillar mounted on said base in rigid relation thereto, a sleeve vertically slidable on the pillar, means locking the sleeve in vertically adjusted position on the pillar, an elongated lever arm pivotally mounted on said sleeve for pivotal movement about a generally horizontal axis, handle means on the end of the lever arm remote from the sleeve to enable the lever arm to be pivoted in relation to the sleeve, and means interconnecting the sleeve and lever arm to resist pivotal movement of the lever arm in relation to the sleeve, said means including air cylinder means pivotally connected to the sleeve and pivotally connected to the lever arm in spaced relation to the pivotal connection between the lever arm and sleeve for resisting pivotal movement of the lever arm and means varying air pressure in the air cylinder means to vary the resistance to movement of the lever arm, said means for varying the air pressure in the air cylinder means including a compressor having an air hose connected with the air cylinder means, a control switch on the sleeve for operating the compressor to raise the air pressure to increase resistance to the lever arm and control means on the sleeve for releasing air pressure from the air cylinder means to reduce pressure in the air cylinder means to reduce resistance to pivotal movement of the lever arm.

2. The structure as defined in claim 1 together with an air pressure guage on the sleeve communicating with the air cylinder means to indicate the air pressure in the air cylinder means and therefore indicate the resistance to movement of the lever arm.

3. The structure as defined in claim 2 wherein said air cylinder means includes a pair of air shock absorbers having a flexible rubber bag incorporated therein with the rubber bag being inflatable and deflatable by operating the switch for the compressor and operating the control means for discharging air from the air chambers.

4. The structure as defined in claim 3 wherein said base includes a longitudinally extending beam having an upright support spaced from the pillar, a bench connected to the upright support and connected to the pillar below the sleeve to enable movement of the lever arm when occupying the bench, said bench and pillar including an adjustable connecting means to enable variation of the inclination of the bench in relation to the base and pillar.

5. The structure as defined in claim 4 together with a leg curl extension device including laterally extending cushioned members for engagement by various components of the legs of a user, means supporting the leg curl extension from the exercise device and cable and pulley means interconnecting the leg curl extension and the lever arm to utilize the lever arm and the air cylinder means to variably resist movement of the leg curl extension.

6. The structure as defined in claim 5 together with an overhead support member rigid with the upper end of the pillar and including pulleys supported thereon, a cable connected to the lever arm and entrained over the pulleys and depending from the end of the overhead support and provided with a lateral bar to enable variable resistance to movement of the lever arm to be transmitted to the bar for performing various, exercise regimens.

7. An exercise device comprising a supporting base, an upright pillar means rigidly mounted at one end of said base, a sleeve vertically slidable on the pillar means, means locking the sleeve in vertically adjusted position on the pillar means, an elongated lever arm pivotally mounted on said sleeve adjacent the lower end thereof for pivotal movement about a generally horizontal axis, a transverse handle bar on the end of the lever arm remote from the sleeve to enable the lever arm to be pivoted in relation to the sleeve, and means interconnecting the sleeve and lever arm to resist pivotal movement of the lever arm in relation to the sleeve, said means including air cylinder means pivotally connected to the the upper end portion of said sleeve and pivotally connected to the lever arm in spaced relation to the pivotal connection between the lever arm and sleeve for resisting pivotal movement of the lever arm and means varying air pressure in the air cylinder means to vary the resistance to movement of the lever arm, said base including a longitudinally extending beam having an upright support spaced from the pillar, a bench connected to the upright support and connected to the pillar below the sleeve to enable movement of the lever arm when occupying the bench, a leg curl extension device including laterally extending cushioned members for engagement by various components of the legs of a user, means supporting the leg curl extension from the upright support for said bench and cable and pulley means interconnecting the leg curl extension and the lever arm to utilize the lever arm and the air cylinder means to variably resist movement of the leg curl extension, said means for varying the air pressure in the air cylinder means including a compressor having an air hose connected with the air cylinder means, a control switch for operating the compressor to raise the air pressure to increase resistance to the lever arm and control means for releasing air pressure from the air cylinder means to reduce pressure in the air cylinder means to reduce resistance to pivotal movement of the lever arm, an air pressure guage on the sleeve communicating with the air cylinder means to indicate the air pressure in the air cylinder means and therefore indicate the resistance to movement of the lever arm, said air cylinder means including a pair of air cylinders having a flexible rubber bag incorporated therein with the rubber bag being inflatable and deflatable by operating the switch for the compressor and operating the control means for discharging air from the air chambers, said pressure gauge being mounted on said sleeve between said air cylinders for easy observation by an occupant on the bench.

* * * * *